US010902832B2

(12) United States Patent
Shen et al.

(10) Patent No.: US 10,902,832 B2
(45) Date of Patent: Jan. 26, 2021

(54) TIMBRE FITTING METHOD AND SYSTEM BASED ON TIME-VARYING MULTI-SEGMENT SPECTRUM

(71) Applicant: Shenzhen Mooer Audio CO., LTD., Shenzhen (CN)

(72) Inventors: Ping Shen, Guangdong (CN); Zhenyu Tang, Guangdong (CN); Jianxiong Zhang, Guangdong (CN)

(73) Assignee: Shenzhen Mooer Audio CO.,LTD., Shenzhen (CN)

( * ) Notice: Subject to any disclaimer, the term of this patent is extended or adjusted under 35 U.S.C. 154(b) by 0 days.

(21) Appl. No.: 16/713,023

(22) Filed: Dec. 13, 2019

(65) Prior Publication Data

US 2020/0273441 A1 Aug. 27, 2020

(30) Foreign Application Priority Data

Feb. 21, 2019 (CN) ..... 2019 1 0128159

(51) Int. Cl.
*G10H 1/06* (2006.01)
*G10H 3/18* (2006.01)

(52) U.S. Cl.
CPC ..... *G10H 3/188* (2013.01); *G10H 1/06* (2013.01)

(58) Field of Classification Search
CPC .... G10H 3/18; G10H 2210/066; G10H 3/186; G10H 7/00; G10H 2210/091; G10H 1/125; G10H 2210/201; G10H 1/383; G10H 1/12; G10H 2210/051; G10H 2250/115; G10H 5/007; G10H 2250/511; G10H 7/002; G10H 1/02; G10H 2250/061; G10H 2250/105; G10H 2250/111; G10H 2250/121; G10H 2250/481; G10H 2250/515; G10H 2250/535

See application file for complete search history.

(56) References Cited

U.S. PATENT DOCUMENTS 5,504,270 A * 4/1996 Sethares ..... G10H 1/125 84/645
5,808,225 A * 9/1998 Corwin ..... G10H 3/125 84/602

(Continued)

*Primary Examiner* — Marlon T Fletcher
(74) *Attorney, Agent, or Firm* — Andrew C. Cheng

(57) ABSTRACT

The disclosure discloses a timbre fitting method and system based on time-varying multi-segment spectrum, the system includes an input device for obtaining audio signals of musical instruments and a segmented multi-model compensation module. The segmented multi-model compensation module learns a timbre of a source musical instrument and a target musical instrument, and establishes a multi-segment model of the sound feature of the source musical instrument and a multi-segment model of the sound feature of the target musical instrument. The sound feature is set to be based on maximum amplitude of the audio signal played the same sequence on the target musical instrument and the source musical instrument, and the audio signal of the sequence is divided into multiple segments according to the amplitude. The sound feature includes frequency spectrums of notes respectively within each amplitude range. The segmented multi-model compensation module establishes a multi-model structure with time-varying gain.

18 Claims, 3 Drawing Sheets

(56) References Cited

U.S. PATENT DOCUMENTS

| | | | | |
|---|---|---|---|---|
| 6,392,135 | B1 * | 5/2002 | Kitayama | G10H 1/0575 84/622 |
| 7,461,002 | B2 * | 12/2008 | Crockett | 704/278 |
| 9,515,630 | B2 * | 12/2016 | Wallander | H04R 3/04 |
| 10,115,381 | B2 * | 10/2018 | Zanetti | G10H 1/0091 |
| 10,186,247 | B1 * | 1/2019 | Rafii | G10H 1/06 |
| 2007/0291959 | A1 * | 12/2007 | Seefeldt | G10L 21/038 381/104 |
| 2009/0038467 | A1 * | 2/2009 | Brennan | G09B 15/00 84/609 |
| 2009/0097676 | A1 * | 4/2009 | Seefeldt | H04S 7/00 381/107 |
| 2013/0019739 | A1 * | 1/2013 | Vainiala | G10H 1/0091 84/622 |
| 2013/0272548 | A1 * | 10/2013 | Visser | G06K 9/4671 381/122 |
| 2017/0024495 | A1 * | 1/2017 | Wang | G06F 17/11 |
| 2018/0088899 | A1 * | 3/2018 | Gillespie | G06F 3/165 |
| 2018/0122347 | A1 * | 5/2018 | Zanetti | G10H 1/0091 |
| 2019/0378532 | A1 * | 12/2019 | Aucouturier | G10L 21/003 |
| 2020/0143779 | A1 * | 5/2020 | Xiao | G10H 1/366 |
| 2020/0267491 | A1 * | 8/2020 | Daly | H04S 7/302 |
| 2020/0273441 | A1 * | 8/2020 | Shen | G10H 3/188 |

* cited by examiner

TIMBRE FITTING METHOD AND SYSTEM BASED ON TIME-VARYING MULTI-SEGMENT SPECTRUM

CROSS-REFERENCE TO RELATED APPLICATION

This application claims priority to Chinese Patent Application No. 201910128159.4 filed on Feb. 21, 2019, the contents of which are incorporated by reference herein.

TECHNICAL FIELD

The subject matter herein generally relates to musical instruments. In particular, it is a timbre fitting method and system based on a time-varying multi-segment spectrum.

BACKGROUND

A sound of a string instrument is produced by a string vibration. Frequency is the most basic physical quantity reflecting vibration phenomenon. A simple periodic vibration has one frequency. However, a complex motion cannot be described through one frequency. A frequency spectrum is a distribution curve of the frequency and is a graph that arranges the vibration amplitude in order of the frequency. Therefore, the frequency spectrum is used to describe a complex vibration. A timbre is the auditory perception of sound. In addition, the timbre represents waveform characteristics of sound in frequency aspect. Every object has unique vibration characteristics, so the timbre of each object is different from others. Any ordinary timbre comprises a few harmonic sounds. In other word, an ordinary timbre comprises a plurality of harmonic sounds and is a complex vibration. Therefore, the timbre of different instruments can be distinguished by analyzing the spectrum of harmonics produced by different musical instruments.

At present, each string instrument usually has only one single timbre. However, during the live show or other situations, a plurality of instruments with a variety of different timbres is needed. Therefore, it is necessary to carry a variety of string instruments with different timbres when people go out. That is the purpose of some devices that can simulate the timbre of various string instruments have appeared. Through the devices, the string instruments do not need to be changed frequently as the timbre is changed.

For example, the U.S. Pat. No. 10,115,381B2 discloses a device, for simulating a sound timbre. In U.S. Pat. No. 10,115,381B2, an input electrical signal generated by a vibration of a source string instrument is obtained. The transfer function is obtained by associating sound features of a target instrument with the sound features of the source instrument. The sound features respectively include the average spectrum of a series of notes played on the target instrument, and the average spectrum of the corresponding notes range played on the source instrument. Then the electrical signal generated by the source instrument is filtered, and be applied by the transfer function, so that the sound timbre of the source instrument can be modified until it is exactly the same as that of the target instrument. But U.S. Pat. No. 10,115,381B2 has deficiencies, as the frequency spectrum of each note changes from the beginning to the end. In addition, a change rule of each note is different from others.

In conclusion, it cannot accurately reflect the sound feature of each note to set the sound feature to be an average spectrum. Therefore, the simulation results are still not accurate enough.

SUMMARY

In order to solve the problems in the prior art, the disclosure provides a timbre fitting system based on time-varying multi-segment spectrum, which the note is segmented according to an amplitude value, so that the sound feature comprises a plurality of frequency spectrums of notes in each amplitude segment, so as to be closer to the law of the actual spectrum change, which makes the timbre of another string instrument of the same type more similar to that of the simulated instrument.

The technical scheme of the present disclosure is as follows:

The present disclosure provides a timbre fitting method based on time-varying multi-segment spectrum, the timbre fitting method based on time-varying multi-segment spectrum comprises:

- obtaining an audio signal of a source musical instrument and an audio signal of a target musical instrument;
- learning a timbre of a source musical instrument and a timbre of a target musical instrument according the audio signals of the source and, target musical instruments;
- establishing a first multi-segment model with a sound feature of the source musical instrument and establishing a second multi-segment model with a sound feature of the target musical instrument; and
- establishing a multi-model structure with time-varying gain based on the difference between the first multi-segment model and the second multi-segment model.

Preferably, each of the sound features of the source and target musical instruments comprises a plurality of frequency spectrums of notes within each amplitude range.

Preferably, each sound feature is set to be based on the maximum amplitude of the audio signal played the same sequence on the target and source musical instruments, and each audio signal of the sequence is configured to be divided into multiple segments according to the amplitude of the audio signal.

Preferably, the multi-model structure with time-varying gain comprises a model parameter, the model parameter comprises time-varying gain values, after the step of establishing a multi-model structure with time-varying gain based on the difference between the first multi-segment model and the second multi-segment model, the timbre fitting method based on time-varying multi-segment spectrum further comprises a step of modifying the timbre of the source musical instrument according to the model parameter to minimize the difference between the sound features of the modified source and target musical instruments.

Preferably, after the step of modifying the timbre of the source musical instrument according to the model parameter, the timbre fitting method based on time-varying multi-segment spectrum further comprises a step of outputting the audio signal of the modified source musical instrument to an amplifier or a loudspeaker through a digital to analog converter.

Preferably, the step of learning a timbre of a source musical instrument and a timbre of a target musical instrument according the audio signals of the source and target musical instruments comprises:

obtaining an audio signal of a source musical instrument from the and an audio signal of a target musical instrument from the notes played by the source and target musical instruments, each audio signal is an analog electrical signal; and converting each analog electrical signal to a digital signal; the digital signals are a series of discrete values.

Preferably, each of the plurality of frequency spectrums of notes within each amplitude range is obtained by summing each frame frequency data within the amplitude range through a weighting coefficient, the weighting coefficient is obtained by the following formula, $$m = \frac{\arctan[(x-s)*f] - \arctan[(-s)*f]}{\arctan[(1-s)*f] - \arctan[(-s)*f]},$$

the letter x stands for a signal amplitude, the letter s stands for a threshold, the letter f stands for a nonlinear factor, and the letter stands for m stands for the weighted coefficient.

Preferably, a value range of the threshold s is 0-0.2, and a value range of the nonlinear factor f is 40-200.

Preferably, the timbre fitting method based on time-varying multi-segment spectrum further comprises a step of setting each time-varying gain value of the multi-model structure into a stable segment and a transition segment according to the amplitude value, wherein an intersection point of the time-varying gain value of two adjacent amplitudes is a midpoint of a time-varying gain curve of two adjacent transition segments.

Preferably, a sum of the time-varying gain values of the two adjacent transition segments of the two adjacent amplitude segments is 1.

Preferably, the audio signal of the source musical instrument is generated by the vibration of the string of the source musical instrument.

The present disclosure also provides a timbre fitting system based on time-varying multi-segment spectrum, the timbre fitting system based on time-varying multi-segment spectrum comprises an input device for obtaining an audio signal of musical instruments and a segmented multi-model compensation module. The segmented multi-model compensation module is configured to learn a timbre of a source musical instrument and a timbre of a target musical instrument, and establish a first multi-segment model of a sound feature of the source musical instrument and a second multi-segment model of a sound feature of the target musical instrument. The sound feature is set to be based on the maximum amplitude of the audio signal played the same sequence on the target musical instrument and the source musical instrument, and the audio signal of the sequence is configured to be divided into multiple segments according to the amplitude of the audio signal. The sound feature comprises a plurality of frequency spectrums of notes within each amplitude range. The segmented multi-model compensation module is configured to establish a multi-model structure with time-varying gain based on the difference between the sound feature of the source musical instrument and the sound feature of the target musical instrument. The multi-model structure with time-varying gain is configured to minimize the difference between the sound feature of the source musical instrument and the sound feature of the target musical instrument, and the timbre fitting system is used to simulate the sound timbre of the string musical instrument.

A time-varying gain value of the multi-model structure is selected according to the amplitude of the audio signal, the time-varying gain value is set into a stable segment and a transition segment according to the amplitude value, an intersection point of the time-varying gain value of two adjacent amplitudes is a midpoint of a time-varying gain curve of the two adjacent transition segments, and the sum of the time-varying gain values of the two adjacent transition segments of the two adjacent amplitude segments is 1.

A limit point of the two adjacent amplitude segments is set to be the intersection point of the time-varying gain value of two adjacent amplitudes corresponding to a value fluctuated within a certain value above and below the amplitude value.

Each of the plurality of frequency spectrums of notes within each amplitude range is obtained by summing each frame frequency data within the amplitude range through a weighting coefficient, the weighting coefficient is obtained by the following formula, $$m = \frac{\arctan[(x-s)*f] - \arctan[(-s)*f]}{\arctan[(1-s)*f] - \arctan[(-s)*f]},$$

wherein the letter x stands for a signal amplitude, the letter s stands for a threshold, the letter f stands for a nonlinear factor, and the letter m stands for the weighted coefficient.

A value range of the threshold s is 0-0.2, and a value range of the nonlinear factor f is 40-200.

When the timbre of a string instrument is simulated, firstly, the input device obtains the analog electrical signal from the notes played by the source and target musical instruments, the electrical signals from obtained from the input device are sent to an analog-to-digital converter, the analog-to-digital converter converts analog electrical signals (especially voltages) to digital signals with a series of discrete values. Secondly, the processing device comprising a processor or a CPU processes the digital signal to define the sound feature of the source and target musical instrument corresponding to the source of the electrical signal, the sound feature comprises a plurality of frequency spectrums of the notes within each amplitude segment, respectively corresponding to the source and target musical instrument, the spectrum recognition corresponds to the sound of the source and target musical instruments. Thirdly, the processor with the segmented multi-model compensation module establishes a multi-model structure with time-varying gain based on the difference between the sound feature of the source musical instrument and the target musical instrument and stores the model parameters in the memory. During the operation, the electrical signal generated by the source musical instrument is filtered, and the multi-model structure with time-varying gain value is applied to the input electrical signal which is generated by the vibration of the string of the source musical instrument, thereby it could modify the tone, until it is minimized the difference from the tone of the target musical instrument.

The beneficial effect of using the technical solution of the disclosure is that the notes would be segmented according to the amplitude value, thereby enabling the sound feature to comprise a plurality of frequency spectrums of the notes respectively within each amplitude range. Compared with the average spectrum of the entire segment, the setting of the disclosure is closer to the rule of actual spectrum variation. Thus, the timbre will be more similar when the timbre of another string instrument of the same type is simulated.

BRIEF DESCRIPTION OF THE ACCOMPANYING DRAWINGS

DETAILED DESCRIPTION OF ILLUSTRATED EMBODIMENTS

Figure 1:
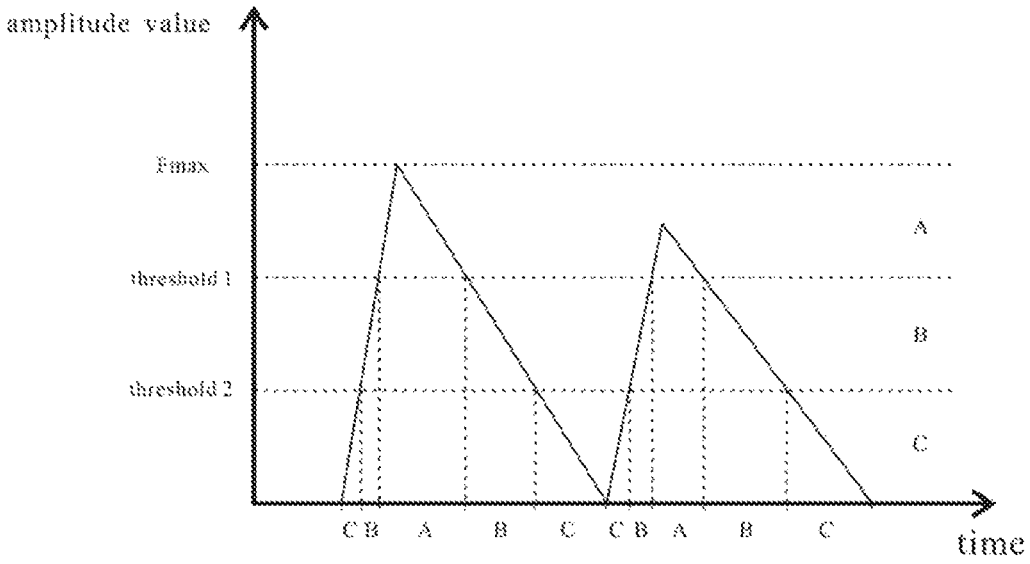
FIG. 1 is a relationship diagram between a spectrum and an amplitude segmentation of one exemplary embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

The term "comprising," when utilized, means "including, but not necessarily limited to"; it specifically indicates open-ended inclusion or membership in the so-described combination, group, series, and the like.

The present disclosure is described in relation to a timbre fitting method and system based on time-varying multi-segment spectrum, thus a timbre of another string instrument of the same type more similar to that of the simulated instrument.

The present disclosure relates to a timbre system, based on time-varying multi-segment spectrum. The timbre fitting system based on time-varying multi-segment spectrum is suitable for fitting a timbre of a string instrument. The timbre fitting system based on time-varying multi-segment spectrum comprises an input device for obtaining an audio signal of musical instruments and a segmented multi-model compensation module. The input device is configured to obtain an audio signal of a source musical instrument and an audio signal of a target musical instrument. In at least one exemplary embodiment, each audio signal is an analog electrical signal of continuous series. Specifically, the audio signal of a source musical instrument and the audio signal of a target musical instrument are obtained from the notes played by the source and target musical instruments, and each audio signal is an analog electrical signal of continuous series. Each analog electrical signal is configured to be converted to a digital signal; in at least one exemplary embodiment, the digital signals are a series of discrete values.

The segmented multi-model compensation module is configured to learn a sound timbre of the source musical instrument and a sound timbre of the target musical instrument according to the audio signals of the source and target musical instruments. The segmented multi-model compensation module is also configured to establish a first multi-segment model of the sound feature of the source musical instrument and a second multi-segment model of the sound feature of the target musical instrument. In at least one exemplary embodiment, as shown in FIG. 1, to play the same sequence of notes on the source and target musical instruments, based on the maximum amplitude Fmax of the notes, the sequence notes are divided into three segments according to the amplitude value to form A, B, and C amplitude segments. The sound features comprise a plurality of frequency spectrum of the notes of the source and target musical instruments within the three amplitude segments A, B, and C, respectively. The segmented multi-model compensation module is configured to establish a multi-model structure (Fir(A)-Fir(B)-Fir(C) with time-varying gains (a,b, c) based on the difference between the sound feature of the source musical instrument and the sound feature of the target musical instrument, according to the learned sound timbres of the source and target musical instruments. The multi-model structure (Fir(A)-Fir(B)-Fir(C) minimizes the difference between the sound feature of the source musical instrument and the sound feature of the target musical instrument. Specifically, the segmented form of the sequence notes can be self-adjusted according to the actual situation, for example, whether the sequence notes are equally divided evenly or how many amplitude segments the sequence notes are divided into.

The multi-model structure with time-varying gain comprises a model parameter, and the model parameter comprises time-varying gain values. The multi-model structure with time-varying gain is configured to modify the timbre of the source musical instrument according to the model parameter to minimize the difference between the sound features of the modified source and target musical instruments. In at least one exemplary embodiment, the audio signal of the modified source musical instrument is configured to be sent to an amplifier or a loudspeaker through a digital to analog converter.

Figure 2:
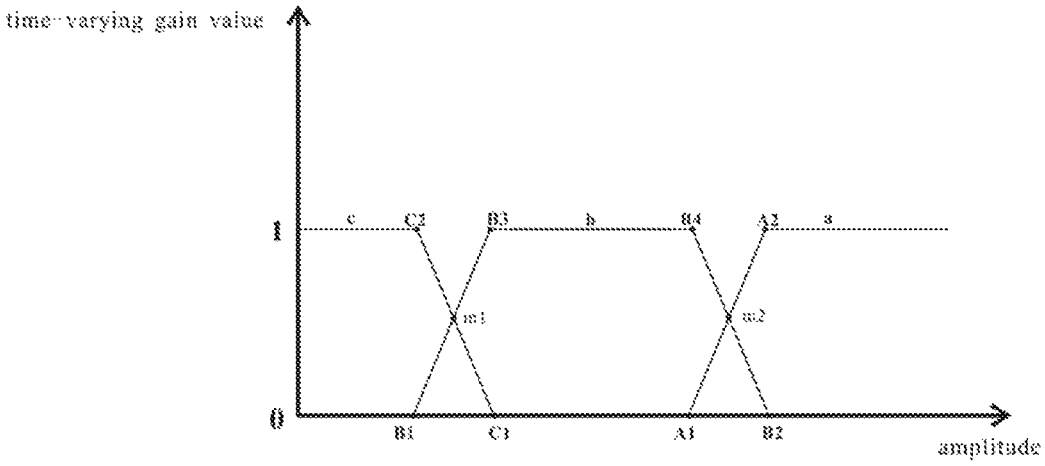
FIG. 2 is a relationship diagram between time-varying gain values and amplitude variations of one exemplary embodiment.

The time-varying gain values (a,b,c) of the multi-model structure (Fir(A)-Fir(B)-Fir(C) are selected according to the amplitude value of the audio signal. As shown in FIG. 2, the time-varying gain values (a,b,c) are set into a stable segment and a transition segment based on the amplitude value. In at least one exemplary embodiment, in stable segment, the value of each time-varying gain value (a, b, c) is 1; in the transition section, the value of each time-varying gain values (a, b, c) goes from 1 to 0 or from 0 to 1.

In at least one exemplary embodiment, the intersection point of the time-varying gain value of the two adjacent amplitudes is the midpoint of the time-varying gain curve of the two adjacent transition segments. For example, a first intersection point m1 between a first segment C1C2 and a second segment B1B3 is a midpoint between the first segment C1C2 and the second segment B1B3, and a second intersection point m2 between a third segment A1A2 and a fourth segment B2B4 is a midpoint between the third segment A1A2 and the fourth segment B2B4.

In at least one exemplary embodiment, a sum of the time-varying gain values between the two adjacent transition segments of the two adjacent amplitude segments is 1. For example, the sum of time-varying gain values c and b between the first segment C1C2 and the second segment B1B3 is 1, and the sum of time-varying gain values a and b between the third segment A1A2 and the fourth segment B2B4 is 1.

The limit point of the two adjacent amplitude segments is set to be the intersection point of the time-varying gain value of two adjacent amplitudes corresponding to a value fluctuated within a certain value above and below the amplitude value. For example, the limit points $B_1$, C1 are set to be m1 within a certain value above and below the amplitude value, and the limit points A1, B2 are set to be m2 within a certain value above and below the amplitude value. Thus, the intersection of the time-varying gain values of the two adjacent amplitude segments is guaranteed to be the mid-point of the time-varying gain curve of the two adjacent transition segments.

Figure 4:
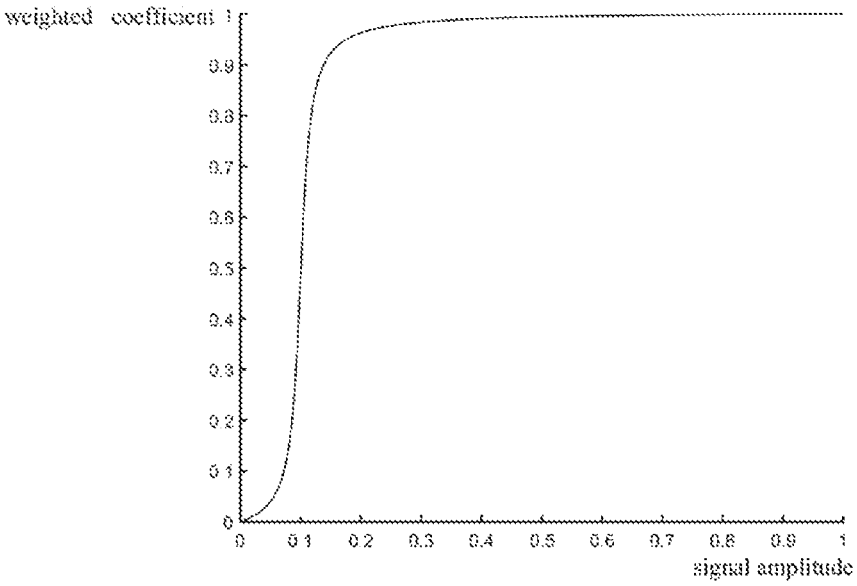
FIG. 4 is a relationship diagram between a weighted coefficient and a signal amplitude of one exemplary embodiment.

Each of the plurality of frequency spectrums of notes within each amplitude range is obtained by summing each frame frequency data within the amplitude range through a weighting coefficient, the weighting coefficient is obtained by the following formula, $$m = \frac{\arctan[(x-s)*f] - \arctan[(-s)*f]}{\arctan[(1-s)*f] - \arctan[(-s)*f]},$$

wherein the letter x is the signal amplitude, the letter s is a threshold, the letter f is a nonlinear factor, and the letter m is the weighted coefficient. In at least one exemplary embodiment, a value range of the threshold s is 0-0.2, and a value range of the nonlinear factor f is 40-200. FIG. 4 illustrates that a relationship between the weighted coefficient and the signal amplitude, in at least one exemplary embodiment, a value of the threshold s is 0.1 and a value of the nonlinear factor f is 80.

Figure 3:
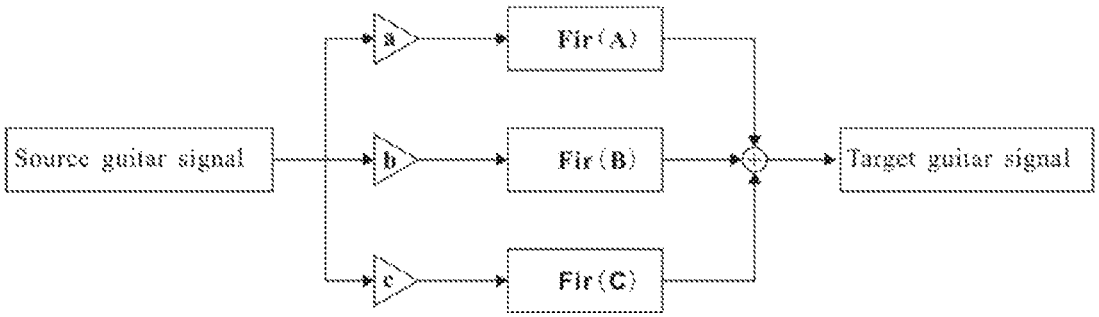
FIG. 3 is an operation diagram of one exemplary embodiment when a source instrument fitted to a target instrument.

The timbre fitting system based on time varying multi-segment spectrum comprises an input device for obtaining electrical signals of the source and target musical instrument, an analog-to-digital converter, a processing device, a memory and a digital to analog converter. The processing device comprises a segmented multi-model compensation module. When the timbre of a string instrument is simulated, firstly, the input device obtains the analog electrical signal from the notes played by the source and target musical instruments, and the electrical signal obtained by the input device is then sent to an analog-to-digital converter, the analog-to-digital converter converts analog electrical signals (especially voltages) with continuous series into digital signals with a series of discrete values. Secondly, the processing device comprises a processor or a CPU processes the digital signal to define the sound feature of the source and target musical instruments corresponding to the source of the electrical signal. The sound feature comprises a plurality of frequency spectrums of the notes within each amplitude segment, respectively corresponding to the source and target musical instrument, the spectrum recognition corresponds to the sound of the source and target musical instrument. Thirdly, the processor with the segmented multi-model compensation module establishes a multi-model structure with time-varying gain based on the difference between the sound feature of the source musical instrument and the target musical instrument and stores the model parameters in the memory. As shown in FIG. 3, during the operation, the electrical signal generated by the source musical instrument is filtered, and the multi-model structure with time-varying gain value is applied to the input electrical signal which is generated by the vibration of the string of the source musical instrument, thereby it could modify the tone, until it is minimized the difference from the tone of the target musical instrument, and output new electrical signal through a digital-to-analog converter and send it to an amplifier or loudspeaker, this new electrical signal has the smallest sound tone difference from the target instrument. FIG. 3 illustrates that each of the source and target musical instruments is a guitar, and an audio signal of the source musical instrument is a source guitar signal and an audio signal of the target musical instrument is a target guitar signal.

Figure 5:
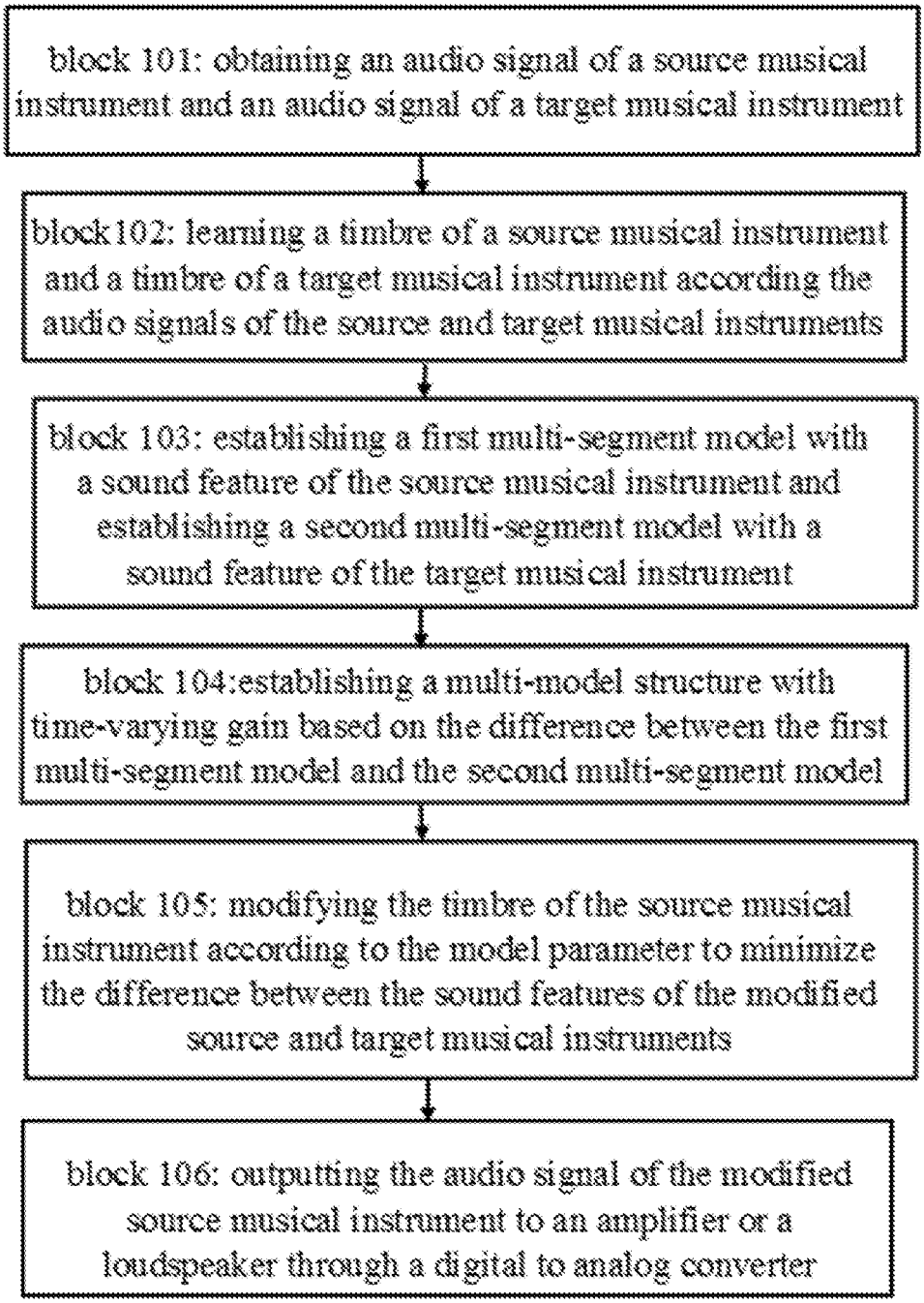
FIG. 5 is a flowchart of a timbre fitting method based on time-varying multi-segment spectrum of one exemplary embodiment.

FIG. 5 illustrates a flowchart of a method in accordance with an example embodiment. A timbre fitting method based on time-varying multi-segment spectrum is provided by way of example, as there are a variety of ways to carry out the method. The illustrated order of blocks is by example only and the order of the blocks can change. Additional blocks may be added or fewer blocks may be utilized without departing from this disclosure. The timbre fitting method based on time-varying multi-segment spectrum can begin at block 101.

At block 101, obtaining an audio signal of a source musical instrument and an audio signal of a target musical instrument. The audio signal of the source musical instrument is generated by the vibration of the string of the source musical instrument At block 102, learning a timbre of a source musical instrument and a timbre of a target musical instrument according the audio signals of the source and target musical instruments.

At block 103, establishing a first multi-segment model with a sound feature of the source musical instrument and establishing a second multi-segment model with a sound feature of the target musical instrument.

At block 104, establishing a multi-model structure with time-varying gain based on the difference between the first multi-segment model and the second multi-segment model.

The multi-model structure with time-varying gain comprises a model parameter, and the model parameter comprises time-varying gain values.

In at least one exemplary embodiment, each of the sound features of the source and target musical instruments comprises a plurality of frequency spectrums of notes within each amplitude range.

In at least one exemplary embodiment, each sound feature is set to be based on a maximum amplitude of the audio signal played the same sequence on the target and source musical instruments, each audio signal of the sequence is configured to be divided into multiple segments according to the amplitude of the audio signal.

In at least one exemplary embodiment, the timbre fitting method based on time-varying multi-segment spectrum further a block 105 after the block 104.

At block 105, modifying the timbre of the source musical instrument according to the model parameter to minimize the difference between the sound features of the modified source and target musical instruments.

In at least one exemplary embodiment, the timbre fitting method based on time-varying multi-segment spectrum further a block 106 after the block 105.

At block 106, outputting the audio signal of the modified source musical instrument to an amplifier or a loudspeaker through a digital to analog converter.

In at least one exemplary embodiment, the block 102 comprises:

obtaining an audio signal of a source musical instrument from the and an audio signal of a target musical instrument from the notes played by the source and target musical instruments; specifically, each audio signal is an analog electrical signal; and converting each analog electrical signal to a digital signal; specifically, the digital signals are a series of discrete values.

Each of the plurality of frequency spectrums of notes within each amplitude range is obtained by summing each frame frequency data within the amplitude range through a weighting coefficient, the weighting coefficient is obtained by the following formula, $$m = \frac{\arctan[(x-s)*f] - \arctan[(-s)*f]}{\arctan[(1-s)*f] - \arctan[(-s)*f]},$$

the letter x stands for a signal amplitude, the letter s stands for a threshold, the letter f stands for a nonlinear factor, and the letter stands for m stands for the weighted coefficient.

In at least one exemplary embodiment, a value range of the thresholds is 0-0.2, and a value range of the nonlinear factor f is 40-200.

The timbre fitting method based on time-varying multi-segment spectrum further comprises a step of setting each time-varying gain value of the multi-model structure into a stable segment and a transition segment according to the amplitude value, specifically, an intersection point of the time-varying gain value of two adjacent amplitudes is a midpoint of a time-varying gain curve of two adjacent transition segments. In at least one exemplary embodiment, a sum of the time-varying gain values of the two adjacent transition segments of the two adjacent amplitude segments is 1.

The exemplary embodiments shown and described above are only examples. Many details are often found in the art such as the other features of a timbre fitting method and system based on time-varying multi-segment spectrum. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, including in matters of shape, size, and arrangement of the parts within the principles of the present disclosure, up to and including the full extent established by the broad general meaning of the terms used in the claims. It will therefore be appreciated that the exemplary embodiments described above may be modified within the scope of the claims.

What is claimed is:

1. A timbre fitting method based on time-varying multi-segment spectrum for fitting a timbre of a string musical instrument, comprising:

obtaining an audio signal of a source musical instrument and an audio signal of a target musical instrument;

learning a timbre of a source musical instrument and a timbre of a target musical instrument according the audio signals of the source and target musical instruments;

establishing a first multi-segment model with a sound feature of the source musical instrument and establishing a second multi-segment model with a sound feature of the target musical instrument; and establishing a multi-model structure with time-varying gain based on the difference between the first multi-segment model and the second multi-segment model;

wherein the multi-model structure with time-varying gain comprises a model parameter, the model parameter comprises time-varying gain values, after the step of establishing a multi-model structure with time-varying gain based on the difference between the first multi-segment model and the second multi-segment model, the timbre fitting method based on time-varying multi-segment spectrum further comprises a step of modifying the timbre of the source musical instrument according to the model parameter to minimize the difference between the sound features of the modified source and target musical instruments.

2. The timbre fitting method based on time-varying multi-segment spectrum according to claim 1, wherein each of the sound features of the source and target musical instruments comprises a plurality of frequency spectrums of notes within each amplitude range.

3. The timbre fitting method based on time-varying multi-segment spectrum according to claim 1, wherein each sound feature is set to be based on a maximum amplitude of the audio signal played the same sequence on the target and source musical instruments, each audio signal of the sequence is configured to be divided into multiple segments according to the amplitude of the audio signal.

4. The timbre fitting method based on time-varying multi-segment spectrum according to claim 1, wherein after the step of modifying the timbre of the source musical instrument according to the model parameter, the timbre fitting method based on time-varying multi-segment spectrum further comprises a step of outputting the audio signal of the modified source musical instrument to an amplifier or a loudspeaker through a digital to analog converter.

5. The timbre fitting method based on time-varying multi-segment spectrum according to claim 2, wherein the step of learning a timbre of a source musical instrument and a timbre of a target musical instrument according the audio signals of the source and target musical instruments comprises:

obtaining an audio signal of a source musical instrument from the and an audio signal of a target musical instrument from the notes played by the source and target musical instruments, wherein each audio signal is an analog electrical signal; and converting each analog electrical signal to a digital signal; wherein the digital signals are a series of discrete values.

6. The timbre fitting method based on time-varying multi-segment spectrum according to claim 1, wherein the step of learning a timbre of a source musical instrument and a timbre of a target musical instrument according the audio signals of the source and target musical instruments comprises:

obtaining an audio signal of a source musical instrument from the and an audio signal of a target musical instrument from the notes played by the source and target musical instruments, wherein each audio signal is an analog electrical signal; and converting each analog electrical signal to a digital signal; wherein the digital signals are a series of discrete values.

7. The timbre fitting method based on time-varying multi-segment spectrum according to claim 1, wherein each of the plurality of frequency spectrums of notes within each amplitude range is obtained by summing each frame frequency data within the amplitude range through a weighting coefficient, the weighting coefficient is obtained by the following formula, $$m = \frac{\arctan[(x-s)*f] - \arctan[(-s)*f]}{\arctan[(1-s)*f] - \arctan[(-s)*f]},$$

the letter x stands for a signal amplitude, the letter s stands for a threshold, the letter f stands for a nonlinear factor, and the letter stands for m stands for the weighted coefficient.

8. The timbre fitting method based on time-varying multi-segment spectrum according to claim 7, wherein a value range of the threshold s is 0-0.2, and a value range of the nonlinear factor f is 40-200.

9. The timbre fitting method based on time-varying multi-segment spectrum according to claim 1, further comprises a step of setting each time-varying gain value of the multi-model structure into a stable segment and a transition segment according to the amplitude value, wherein an intersection point of the time-varying gain value of two adjacent amplitudes is a midpoint of a time-varying gain curve of two adjacent transition segments.

10. The timbre fitting method based on time-varying multi-segment spectrum according to claim 9, wherein a sum of the time-varying gain values of the two adjacent transition segments of the two adjacent amplitude segments is 1.

11. The timbre fitting method based on time-varying multi-segment spectrum according to claim 1, wherein the audio signal of the source musical instrument is generated by the vibration of the string of the source musical instrument.

12. The timbre fitting method based on time-varying multi-segment spectrum according to claim 7, wherein a value range of the threshold s is 0-0.2, and a value range of the nonlinear factor f is 40-200.

13. A timbre fitting system based on time-varying multi-segment spectrum for fitting a timbre of a string musical instrument, comprising:

an input device for obtaining an audio signal of a source musical instrument and an audio signal of a target musical instrument; and a segmented multi-model compensation module configured to:

learn a timbre of a source musical instrument and a timbre of a target musical instrument; and establish a first multi-segment model of a sound feature of the source musical instrument and a second multi-segment model of the sound feature of the target musical instrument;

wherein each sound feature is set to be based on a maximum amplitude of the audio signals played the same sequence on the target musical instrument and the source musical instrument;

wherein each audio signal of the sequence is configured to be divided into multiple segments according to the amplitude of the audio signal;

wherein each sound feature comprises a plurality of frequency spectrums of notes within each amplitude range;

wherein the segmented multi-model compensation module is configured to establish a multi-model structure with time-varying gain based on the difference between the sound feature of the source musical instrument and the sound feature of the target musical instrument;

wherein multi-model structure with time-varying gain is configured to minimize the difference between the sound feature of the source instrument and the sound feature of the target instrument; and wherein each of the plurality of frequency spectrums of notes within each amplitude range is obtained by summing each frame frequency data within the amplitude range through a weighting coefficient, the weighting coefficient is obtained by the following formula, $$m = \frac{\arctan[(x-s)*f] - \arctan[(-s)*f]}{\arctan[(1-s)*f] - \arctan[(-s)*f]},$$

the letter x stands for a signal amplitude, the letter s stands for a threshold, the letter f stands for a nonlinear factor, and the letter stands for m stands for the weighted coefficient.

14. The timbre fitting system based on time-varying multi-segment spectrum according to claim 13, wherein each time-varying gain value of the multi-model structure is selected according to the amplitude of the audio signal, each time-varying gain value is set into a stable segment and a transition segment according to the amplitude value, an intersection point of the time-varying gain value of two adjacent amplitudes is a midpoint of a time-varying gain curve of two adjacent transition segments, and a sum of the time-varying gain values of the two adjacent transition segments of the two adjacent amplitude segments is 1.

15. The timbre fitting system based on time-varying multi-segment spectrum according to claim 14, wherein a limit point of the two adjacent amplitude segments is set to be the intersection point of the time-varying gain value of two adjacent amplitudes corresponding to a value fluctuated within a certain value above and below the amplitude value.

16. The timbre fitting system based on time-varying multi-segment spectrum according to claim 13, wherein a value range of the threshold s is 0-0.2, and a value range of the nonlinear factor f is 40-200.

17. The timbre fitting system based on time-varying multi-segment spectrum according to claim 13, wherein the audio signal of the source musical instrument is generated by the vibration of the string of the source musical instrument.

18. A timbre fitting method based on time-varying multi-segment spectrum for fitting a timbre of a string musical instrument, comprising:

obtaining an audio signal of a source musical instrument and an audio signal of a target musical instrument;

learning a timbre of a source musical instrument and a timbre of a target musical instrument according the audio signals of the source and target musical instruments;

establishing a first multi-segment model with a sound feature of the source musical instrument and establishing a second multi-segment model with a sound feature of the target musical instrument; and establishing a multi-model structure with time-varying gain based on the difference between the first multi-segment model and the second multi-segment model;

wherein each of the plurality of frequency spectrums of notes within each amplitude range is obtained by summing each frame frequency data within the amplitude range through a weighting coefficient, the weighting coefficient is obtained by the following formula, $$m = \frac{\arctan[(x-s)*f] - \arctan[(-s)*f]}{\arctan[(1-s)*f] - \arctan[(-s)*f]},$$

the letter x stands for a signal amplitude, the letter s stands for a threshold, the letter f stands for a nonlinear factor, and the letter stands for m stands for the weighted coefficient.

* * * * *